US007811143B2

(12) United States Patent
Hawkes

(10) Patent No.: US 7,811,143 B2
(45) Date of Patent: Oct. 12, 2010

(54) SHAFT SEAL PRESSURE COMPENSATION SYSTEM FOR AN UNDERWATER DEVICE

(76) Inventor: Calvert Hawkes, 413 Partridge Cir., Sarasota, FL (US) 34236

( * ) Notice: Subject to any disclaimer, the term of this patent is extended or adjusted under 35 U.S.C. 154(b) by 203 days.

(21) Appl. No.: 12/131,944

(22) Filed: Jun. 3, 2008

(65) Prior Publication Data

US 2009/0293794 A1 Dec. 3, 2009

(51) Int. Cl.
*B63H 23/36* (2006.01)
*B63G 8/00* (2006.01)

(52) U.S. Cl. ..... 440/112; 114/312

(58) Field of Classification Search ..... 440/112; 114/312, 337, 338

See application file for complete search history.

(56) References Cited

U.S. PATENT DOCUMENTS 1,131,712 A * 3/1915 Klein ..... 114/312
4,771,320 A 9/1988 Gell
5,399,855 A * 3/1995 Rouleau et al. ..... 250/239
6,665,789 B1 * 12/2003 Stecker, Sr. ..... 114/315
6,800,114 B2 * 10/2004 Vanderhoof et al. ..... 95/117

* cited by examiner

*Primary Examiner*—Daniel V Venne
(74) *Attorney, Agent, or Firm*—Maxey Law Offices, PLLC; Stephen Lewellyn

(57) ABSTRACT

A shaft seal pressure compensation system for an underwater device such a remotely operated vehicle powered by motor driven thrusters where the shaft of the motor extends from a motor housing into the surrounding water and is sealed by a shaft seal by automatically supplying air to pressurize the thrusters to balance the internal pressure of the thrusters to match the ambient water pressure. The air is supplied by a variable volume container that responsive to a pressure differential between the external ambient pressure and an internal pressure within the variable volume gas container for adjusting the volume of the variable volume gas container so that the internal pressure equals the ambient pressure, and thus balancing the system.

18 Claims, 7 Drawing Sheets

SHAFT SEAL PRESSURE COMPENSATION SYSTEM FOR AN UNDERWATER DEVICE

FILED OF THE INVENTION

The present invention relates generally to shaft seals for underwater use, and more particularly, relating to shaft seal pressure compensation system for equalizing pressure across a thruster motor shaft seal of an underwater vehicle.

BACKGROUND OF THE INVENTION

Inspection class Remote Operated Vehicles (ROVs) are typically used to position a video camera underwater. The ROV usually contains electronics that are connected to a base station by a wire tether. Motor driven propellers called thrusters are used to move the ROV.

A problem with existing ROVs concerns the shaft seals inside the thrusters. In the past, inexpensive shaft seals were generally not used for thruster applications because of the pressure differential that occurs on either side of the seal. These seals may tolerate a pressure differential from the wet side to the dry side of 5 PSI. However, the pressure underwater increases approximately 1 PSI for every two feet of depth, so the low cost seal would leak at a depth of greater than 10 feet. ROVs may typically be used at depths of at least 25 feet. In order to solve this problem, more expensive seals are used which have a higher depth rating. The use of more expensive seals increases the production and maintenance costs of ROVs. Additionally, the traditional expensive seals are bulky and require ROVs using these seals to be constructed larger to accommodate the these seals, which also increases the production cost of the ROVs. The high costs associated with the manufacture and maintenance of traditionally built ROVs with expensive shaft seals reduces the ability for the consumer market to purchase ROVs.

Accordingly, there is a need to use less expensive shaft seals in such a way that the seals can be used at depths greater than 10 feet, which also reduces the costs of manufacturing and maintaining ROVs, thereby making ROVs more affordable to the consumer market.

SUMMARY OF THE INVENTION

The preferred embodiments of the present invention addresses this need by compensating the internal pressure acting on the inner side of the shaft seal according to the external pressure acting on the wet side of the shaft seal. Pressure compensation is accomplished by using a variable volume space containing air that is exposed to the external pressure. As the external pressure increases when submerging the ROV, the air contained by the variable volume space is compressed according to Boyle's Law, thereby increasing the internal pressure accordingly until an equilibrium is reached between the internal pressure and external pressure, and thus eliminating any appreciable pressure differential from occurring on opposing sides of the shaft seal. Likewise, as the external pressure decreases when raising the ROV to a shallower depth, pressure equalization across the shaft seal is maintained.

To achieve these and other advantages, in general, in one aspect, a shaft seal pressure compensation system for equalizing pressure across a shaft seal of an underwater device is provided. The system includes a variable volume gas container responsive to a pressure differential between an external ambient pressure and an internal pressure within the variable volume gas container for adjusting the volume of the variable volume gas container so that the internal pressure equals the ambient pressure, a motor housing defining an enclosed internal space, a motor within the enclosed internal space and having a shaft extending from the internal space outwardly of the motor housing and terminating at an external location of the motor housing, a shaft seal between the motor housing and the shaft for making sealing contact between the shaft and the motor housing, the variable volume gas container being pneumatically connected to the motor housing to allow the free exchange of air between the variable volume gas container and the motor housing for pressurizing the enclosed internal space of the motor housing so that it equals the ambient pressure, thereby equalizing the pressure across the shaft seal to within the operational differential pressure tolerances of the shaft seal.

In general, in another aspect, a remotely operated underwater vehicle having a shaft seal pressure compensation system for equalizing pressure across a shaft seal of each motor driven thruster is provided. The vehicle includes at least one motor driven thruster for providing a combination of propulsion and direction control to the vehicle; the at least one motor drive thruster including, a motor housing defining an enclosed internal space, a motor within the enclosed internal space and having a shaft extending from the internal space outwardly of the motor housing and terminating at an external location of the motor housing, a shaft seal between the motor housing and the shaft for making sealing contact between the shaft and the motor housing, a variable volume gas container responsive to a pressure differential between an external ambient pressure and an internal pressure within the variable volume gas container for adjusting the volume of the variable volume gas container so that the internal pressure equals the ambient pressure, the variable volume gas container being pneumatically connected to the motor housing to allow the free exchange of air between the variable volume gas container and the motor housing for pressurizing the enclosed internal space of the motor housing so that it equals the ambient pressure, thereby equalizing the pressure across the shaft seal to within the operational differential pressure tolerances of the shaft seal.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
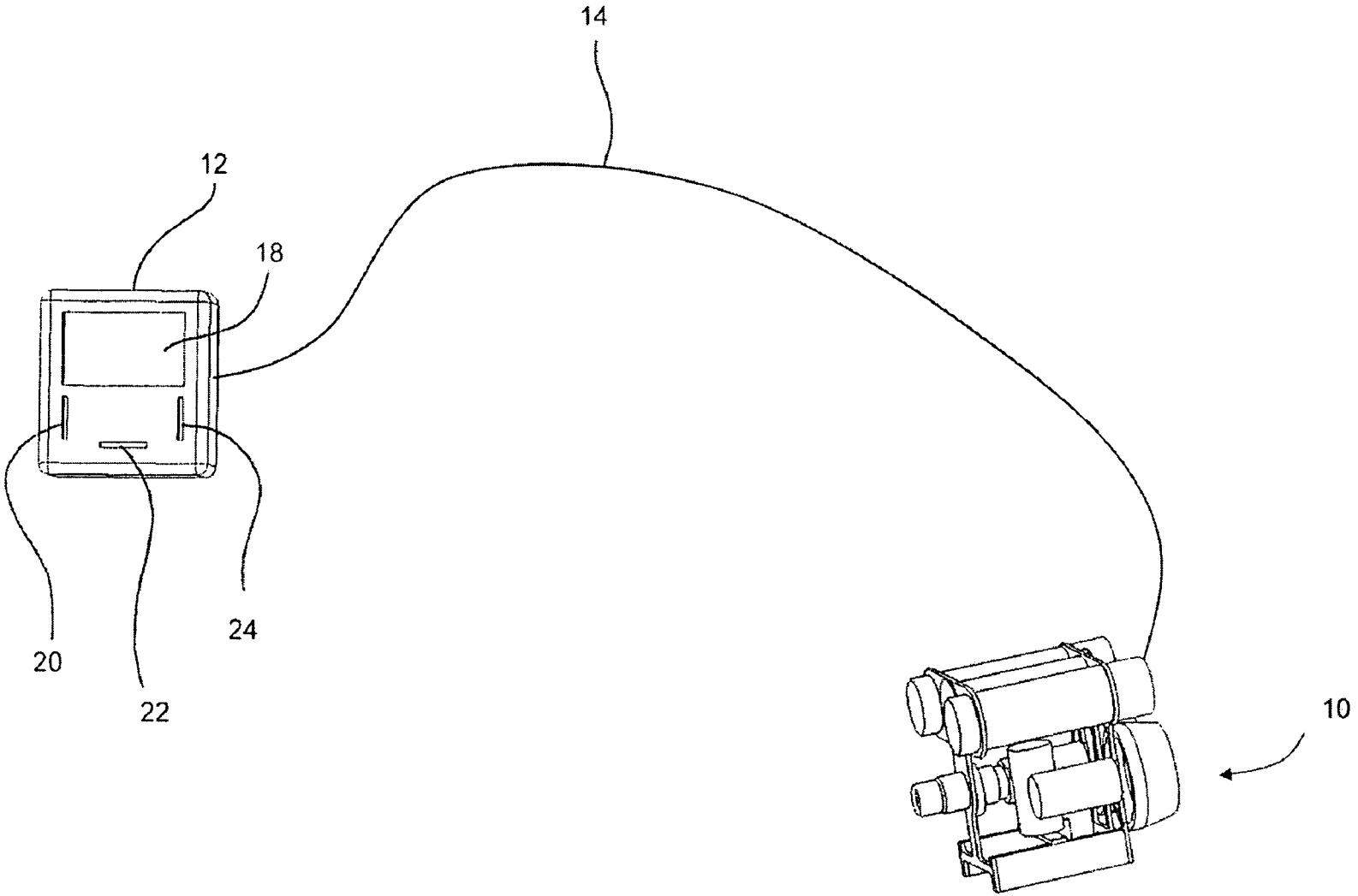
FIG. 1 is a diagrammatic perspective view of a remotely operated vehicle and control unit for use in connection with the shaft seal pressure compensation system for use with an underwater device in accordance with the principles of the present invention.
Figure 2:
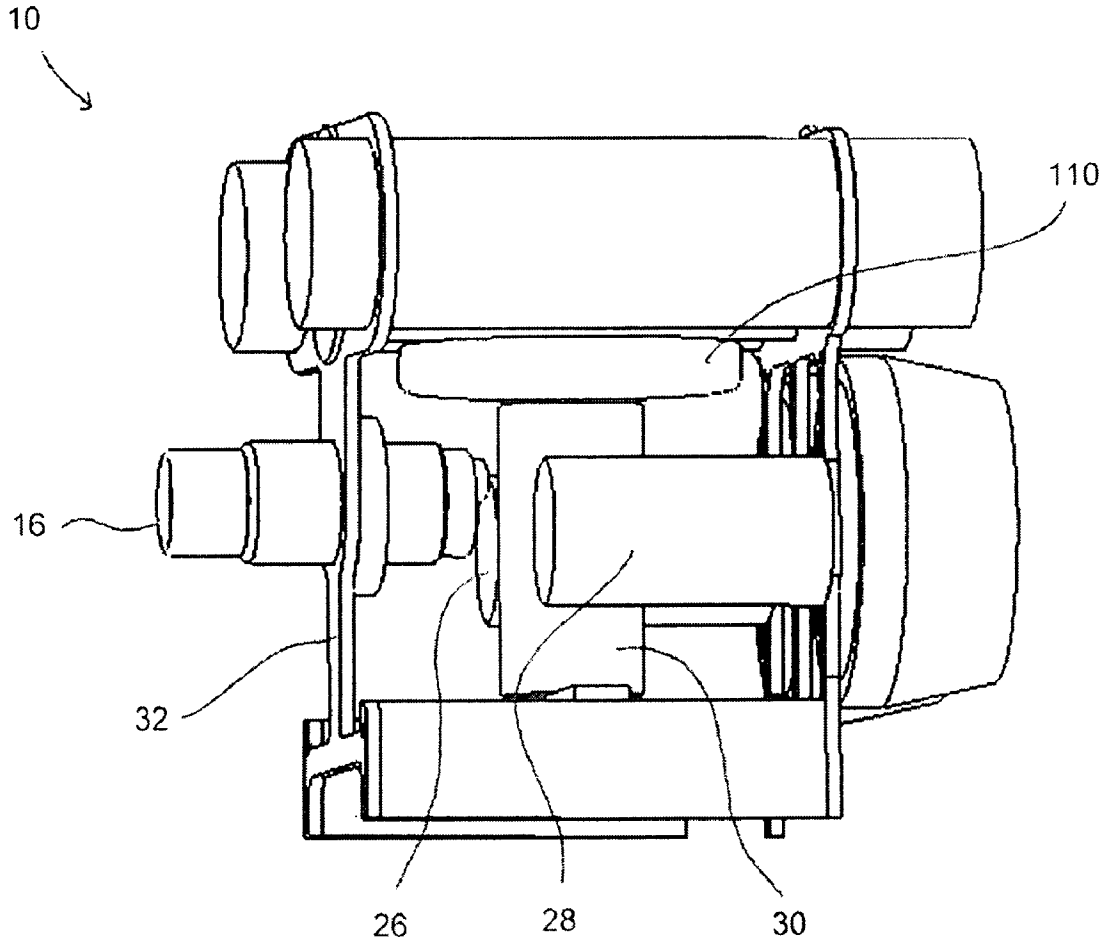
FIG. 2 is a diagrammatic perspective view of the remotely operated vehicle perspective view of FIG. 1.

In FIG. 1, there is shown a diagrammatic perspective view of an exemplarily remote operated vehicle ROV 10 that may used in connection with the pressure compensation across a shaft seal in accordance with the principals of the present invention. The ROV 10 is connected to a base station 12 by control tether 14. The output of an ROV video camera 16 is displayed in real time on the screen of the display 18, and controls 20, 22 and 24 are used to control the movement of the ROV 10. Controls 20, 22, 24 are used to pilot the ROV 10 so as to position ROV 10 in order to display the desired information on display 18. With reference to FIG. 2, an enlarged perspective view of the exemplarily remote vehicle is shown. The ROV 10 generally includes the camera 16, horizontal thrusters 26 and 28, vertical thruster 30 all mounted to a frame 32, and a variable volume container 110.

Figure 3:
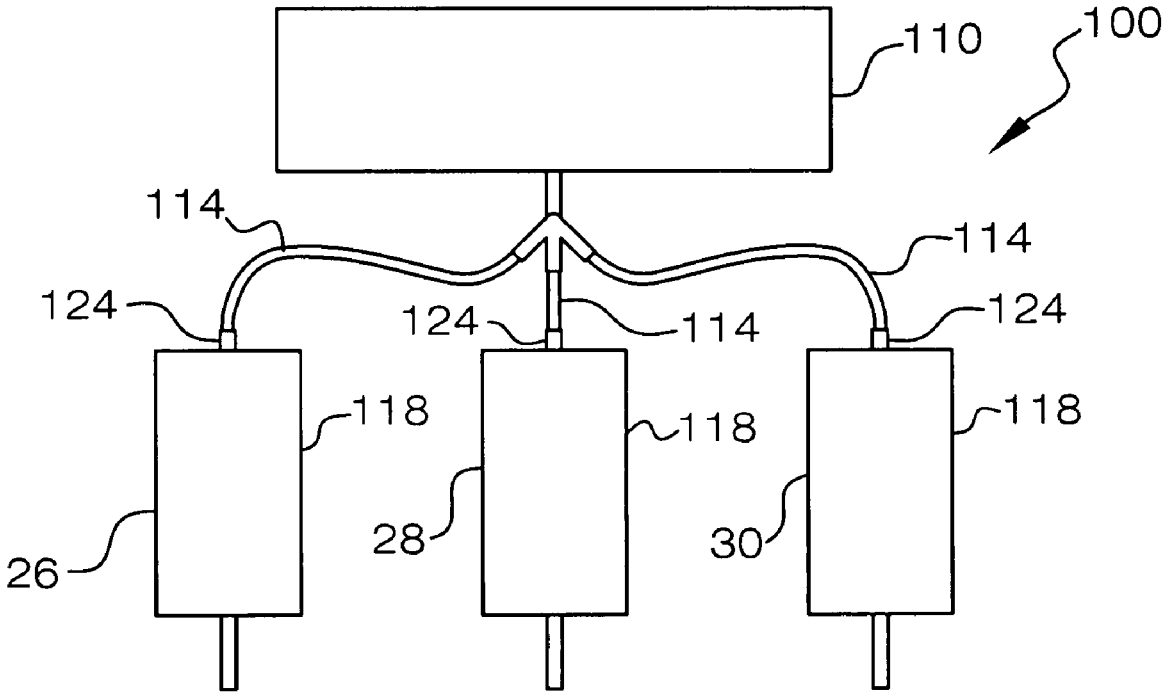
FIG. 3 is a diagrammatic view of the shaft seal pressure compensation system for use with an underwater device.

FIG. 3 illustrates the pressure compensation system 100 in accordance with the principals of the present invention. The pressure compensation system 100 includes a variable volume gas container 110 filled with air that is responsive to a pressure differential between an external ambient pressure and the internal pressure within the container for adjusting the volume of the container so that the pressure within container equals the external ambient pressure. The variable volume container 110 is pneumatically connected to each motor housing 118 of one or more of the thrusters 26, 28, 30 so as to allow the free exchange of air between the variable volume container and each motor housing. Flexible tubing 114 may provide the pneumatic connection between the variable container 110 and the motor housing 118. While the variable volume container 110 is shown attached to each motor housing 118 it may be attached in any combination to the various motor housings present.

Figure 4:
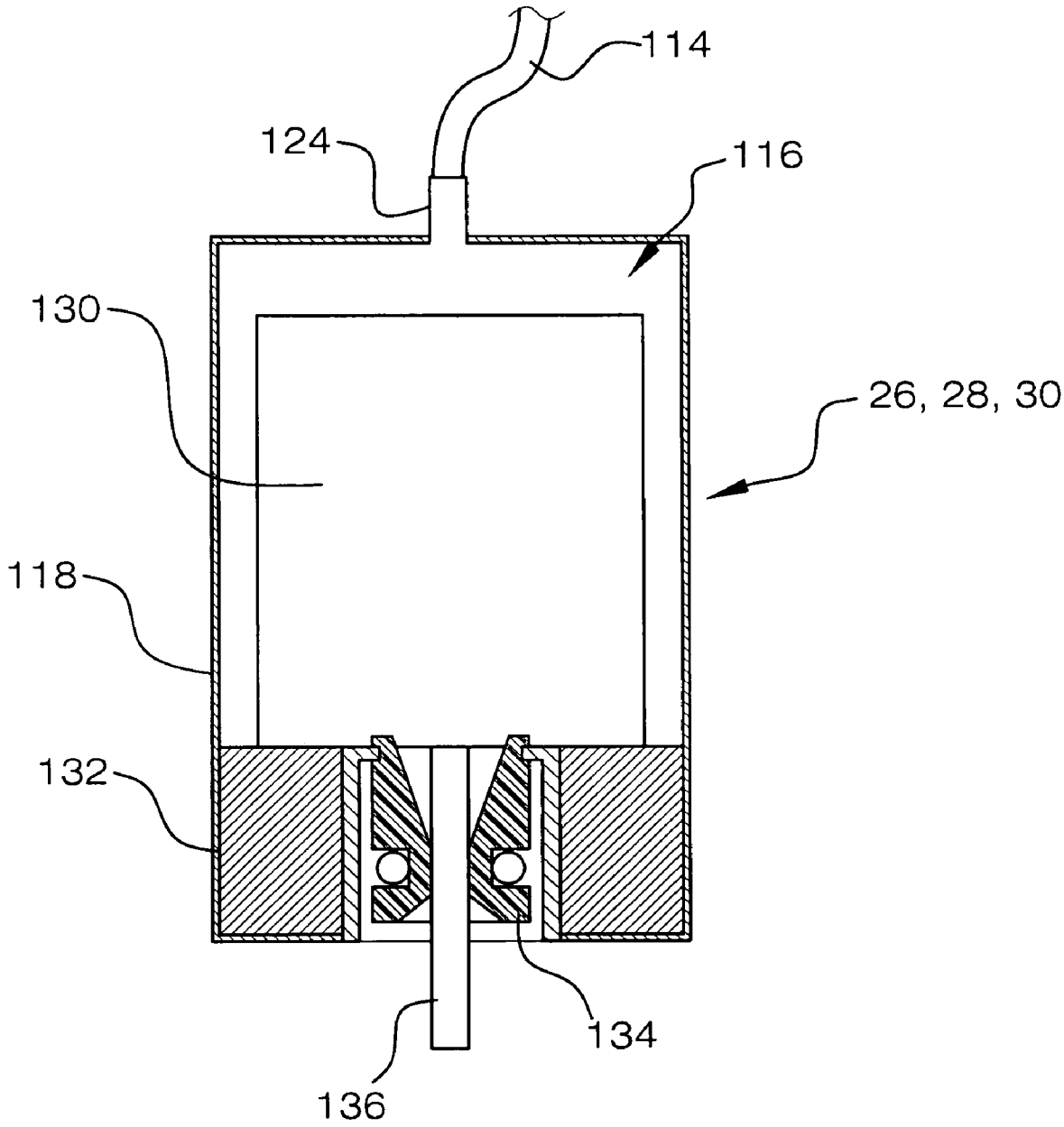
FIG. 4 is a diagrammatic cross-sectional view of a motor housing comprising the pressure compensated shaft seal.

With reference to FIG. 4, which shows diagrammatic cross-section of the motor housing 118. The motor housing 118 has an enclosed internal space 116 which contains a motor 130 mounted to a motor mount 132. The motor 130 may be a low cost, brushed DC motor, although brushless motors may be used where weight is more important than cost. The motor 130 may include a gearbox (not shown). A shaft seal 134 is pressed into motor mount 132, through which motor shaft 136 extends. A propeller (not shown) would connect to the end of motor shaft 136. The shaft seal 134 may be a low cost radial shaft seal with a rubber coating and a short, flexibly suspended spring loaded sealing lip.

The variable volume container 110 may have a volume that is at least equal to the volume the dead space of each enclosed internal space 116 of each motor housing 118 to which the variable volume container is attached. Dead space is defined herein as the space within the enclosed internal space 116 of the motor housing 118 that is not occupied by the various components located within the enclosed internal space, such as the motor 130, the motor mount 132, the motor shaft 136, etc.

In operation, as the device, such as the ROV 10, containing the pressure compensation system 100 is submerged, the ambient pressure of the water on the variable volume container 110 causes the volume of the variable volume container to adjust so that the internal pressure of the variable volume container equals the ambient pressure according to the principals of Boyle's Law, which equally adjusts the pressure within in the enclosed internal space 116 of each motor housing 118 so that it equals the ambient pressure of the water, thereby equalizing pressure across the shaft seal 134 to within the operational differential pressure of the shaft seal. As the ROV 10 ascends, the ambient pressure is less than the pressure within the motor housings 118 and the variable volume container 110. The higher pressure in the motor housings 118 and the variable volume container 110 forces the volume of the variable volume container to increase to equalize the internal pressure with the ambient pressure. The operational differential pressure of the shaft seal 134 may be 5 PSI.

Figure 5A:
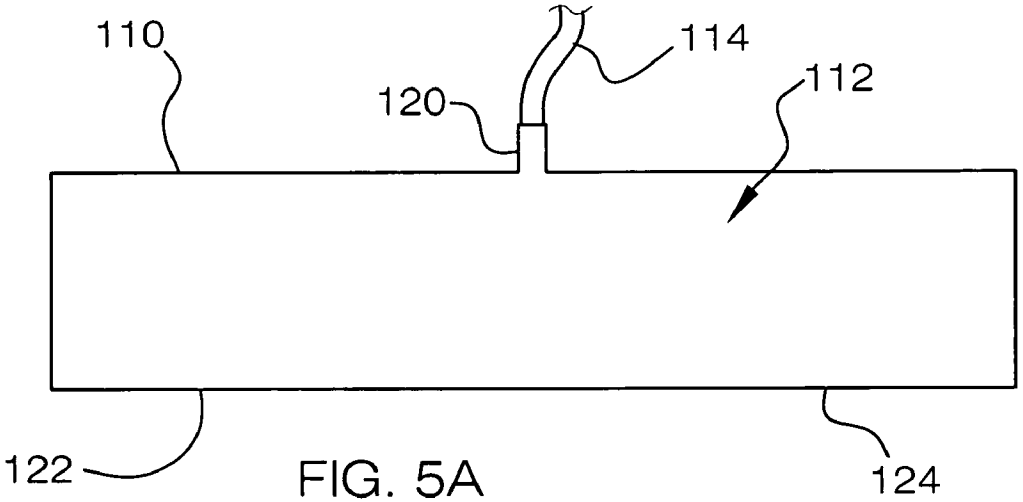
FIG. 5A is a diagrammatic cross-sectional view of a variable volume container in accordance with the principles of the present invention illustrating the variable volume container in low ambient pressure.
Figure 5B:
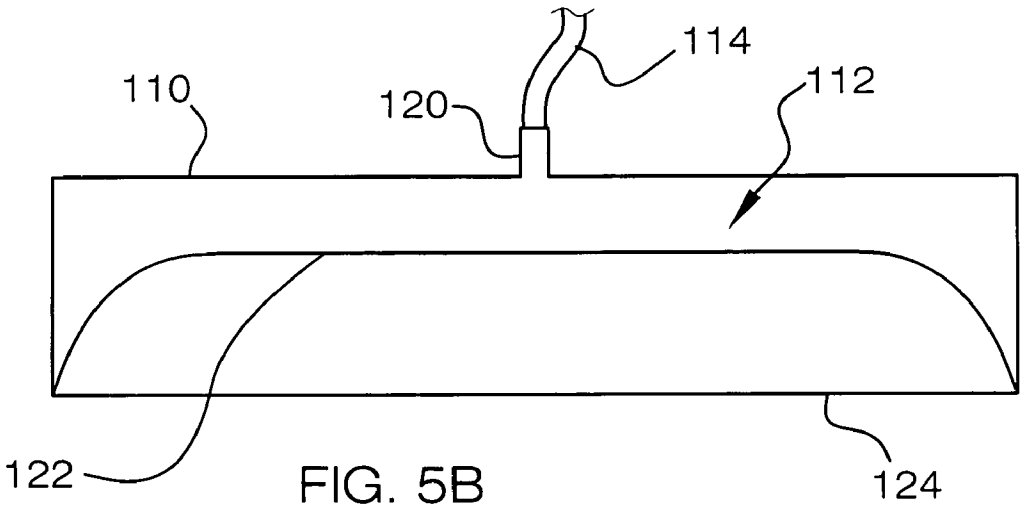
FIG. 5B is the variable volume container of FIG. 5A illustrating the variable volume container at a higher ambient pressure.

FIGS. 5A and 5B illustrates a cross-sectional view of the variable volume container 110. Fitting 120 is a barbed fitting or luer fitting used to connect the tubing 114, such as flexible tubing, to one or more fittings 124 on the thruster motor housing 118. Membrane 122 creates a flexible diaphragm over an open end 124 of the pressure housing 110. FIG. 5A shows diaphragm 122 when the pressure compensation system 100 is at low pressure such as when the device or ROV 10 is on land or at shallow depths. FIG. 5B shows diaphragm 122 when the pressure compensation system 100 is at increased depth, causing diaphragm to deform and compress air contained inside the pressure housing 110. Increased pressure is conveyed to one or more thruster motor housings 118 through tubing 114 connected to fitting 120 on pressure housing and one or more fittings 124 on the thruster housings. Increased pressure in thruster motor housings 118 acts on internal side 126 of shaft seal 128, as seen in FIG. 5, to offset increased external pressure on the shaft seal, thus allowing the shaft seal to maintain shape and resist deformation due to higher operating pressure.

Figure 6A:
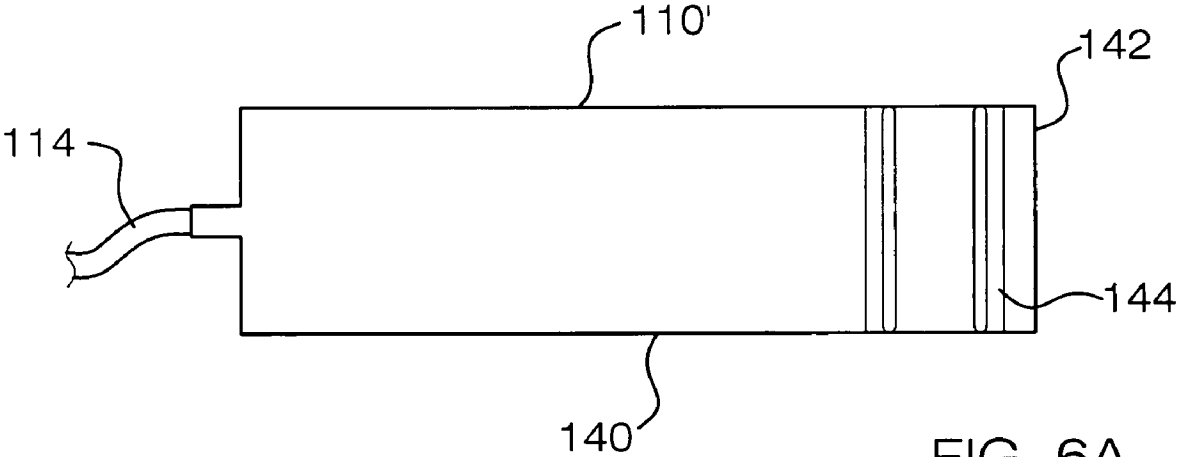
FIG. 6A is a diagrammatic cross-sectional view of an alternate variable volume container in accordance with the principles of the present invention illustrating the variable volume container in low ambient pressure.
Figure 6B:
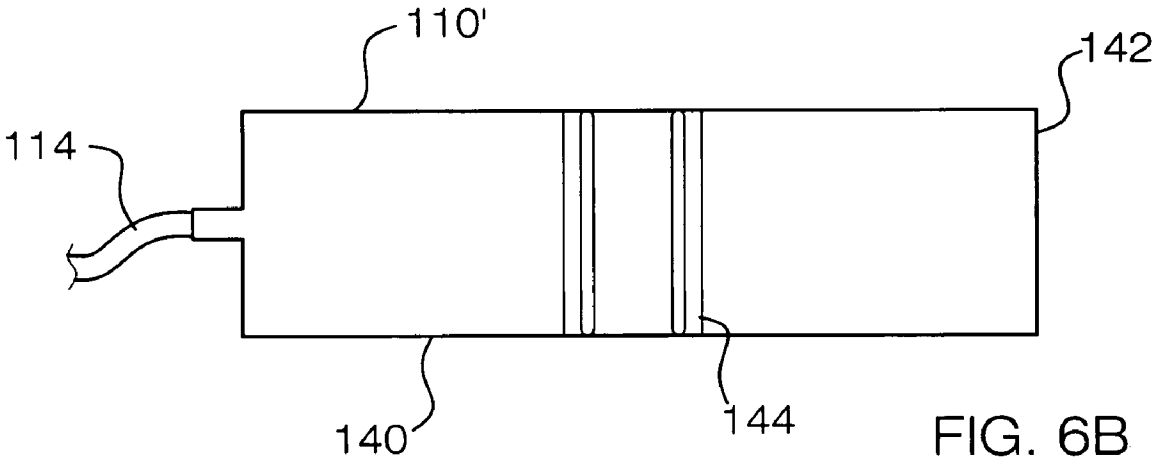
FIG. 6B is the variable volume container of FIG. 6A illustrating the variable volume container at a higher ambient pressure.

FIGS. 6A and 6B illustrate an alternative variable volume container 110'. For clarity, only the differences in the variable volume container 110' will be described. The variable volume container 110' includes an elongated cylindrical body 140 pneumatically connected to one or more motor housings at one end. The other end 142 of the body 140 is open to the ambient environment and a free piston 144 provides a movable gas tight seal within the body. FIG. 6A shows the position of the piston 144 when the pressure compensation system 100 is at low pressure such as when the device or ROV 10 is on land or at shallow depths. FIG. 6B shows the piston 144 when the pressure compensation system is at increased depth, causing the piston to move inwardly into the body 140 adjusting the volume of the variable volume container 110', and compressing air contained therein. Increased pressure is conveyed to one or more thruster motor housings 118 through tubing 114.

An issue that could arise with this method of pressure compensation is that an excessive change in ROV displacement could occur. For example, if each thruster motor housing 118 contained 10 cc of dead space, the membrane housing would have to change in displacement by 30 cc in order to double the internal pressure of the three thrusters. This may have the undesired effects of causing the displacement of the pressure housing 110, and thus the ROV, to change greatly with depth. This problem can be largely overcome by minimizing the air volume in each thruster motor housings 118. For example, if the thruster motor housing includes 60 cc of total space, but there is only 2 cc of dead space contained in each housing, then only 9 cc of total free space is required in the pressure housing 110 to provide a 2.5:1 ratio in pressure. Therefore, the thruster motor housing 118 can be designed to minimize dead space. This can be accomplished by the following: choosing an inside diameter for the cylindrical housing that closely matches the outside diameter of the motor 130; integrating the gearbox into the motor mount such the gearbox is solid except for the areas which contain the spur gears; and fitting a lightweight flywheel inside the motor so as to reduce the free space.

Additionally, the change in displacement of the ROV due to the pressure compensation may be offset by the vertical thruster 30. The displacement can be offset by increasing the speed of vertical thruster 30, either manually or automatically if for example a pressure sensor input is available to a microprocessor contained in the base station. Alternatively, additional circuitry in ROV 10 could use an on board pressure sensor input to locally adjust the speed of vertical thruster 30 so as to maintain a desired depth.

Another issue involved with dynamically changing the ROV displacement with depth is that depending on the location of the pressure housing 110, the center of buoyancy of the device or ROV 10, and thus the horizontal orientation of the device or ROV, can be effected. This could have the undesired effect of causing the ROV 10 to rotate as it descends. Although this effect could be partially compensated for by using a pan/tilt camera, this solution would require additional cost. A preferred solution is to design the variable volume container 110 such that is symmetrical both fore and aft and also side to side, and to locate the container approximately at the center of buoyancy of the device or ROV 10. In this manner, the orientation of the camera can be kept relatively constant regardless of depth.

Figure 7A:
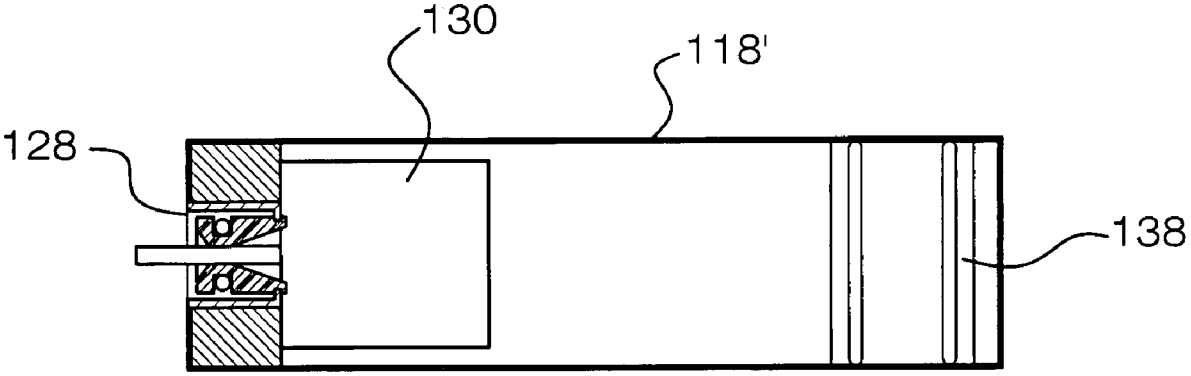
FIG. 7A is a diagrammatic cross-sectional view of an alternate motor housing which comprises the variable volume container in accordance with the principles of the present invention illustrating the motor housing in low ambient pressure.
Figure 7B:
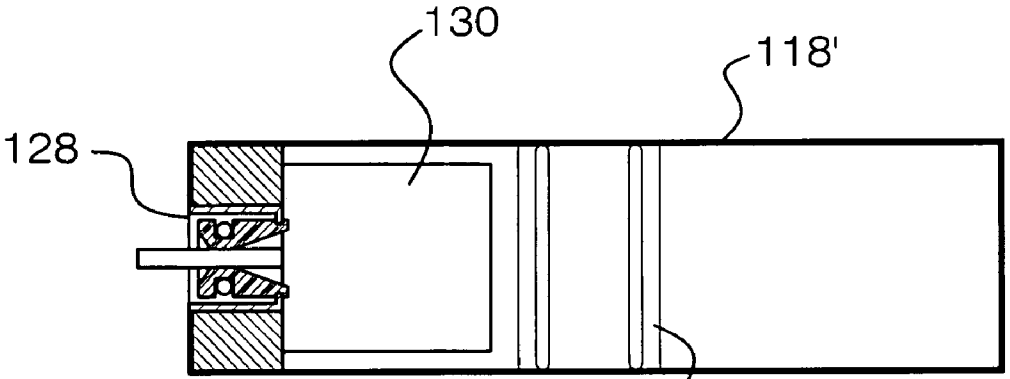
FIG. 7B is the motor housing of FIG. 7A illustrating the variable volume container at a higher ambient pressure.

In an alternate embodiment, each motor housing 118 of can be individually compensated for pressure, and thus removing the need for a separated variable volume container. In this embodiment, the motor housing 118' is modified slightly from motor housing 118 to comprises the variable volume container. FIG. 7A is a diagrammatic cross-section of a thruster illustrating one example of this embodiment. In this example, motor 130 is contained inside the thruster motor housing 118 which is constructed as a cylinder. The thruster motor housing is sealed at one end with a shaft seal 128, and at the other end with movable plunger 138. FIG. 7A, shows the approximate location of plunger 138 when the thruster is at low pressure, for example at the surface. When the thruster is moved to a deeper location underwater, the external water pressure rises, causing plunger 138 to move inside the housing 118, compressing the internal air and preventing shaft seal 128 from leaking as shown in FIG. 7B. In an alternative configuration, the plunger could be replaced by a diaphragm or a flexible housing.

A number of embodiments of the present invention have been described. Nevertheless, it will be understood that various modifications may be made without departing from the spirit and scope of the invention. Accordingly, other embodiments are within the scope of the following claims.

What is claimed is:

1. A shaft seal pressure compensation system for equalizing pressure across a shaft seal of an underwater device, the system comprising in combination:

a variable volume gas container responsive to a pressure differential between an external ambient pressure and an internal pressure within said variable volume gas container for adjusting the volume of said variable volume gas container so that said internal pressure equals said ambient pressure;

a motor housing defining an enclosed internal space;

a motor within said enclosed internal space and having a shaft extending from said internal space outwardly of said motor housing and terminating at an external location of said motor housing;

a shaft seal between said motor housing and said shaft for making sealing contact between said shaft and said motor housing;

said variable volume gas container being pneumatically connected to said motor housing to allow air to freely exchange between said variable volume gas container and said motor housing for pressurizing said enclosed internal space of said motor housing so that it equals said ambient pressure, thereby equalizing the pressure across said shaft seal.

2. The system according to claim 1, wherein said variable volume gas container is located at the center of buoyancy of the underwater device.

3. The system according to claim 2, wherein said variable volume gas container comprises:

a flexible diaphragm that is responsive to a pressure differential between said external ambient pressure and said internal pressure within said variable volume gas container for adjusting the volume of said variable volume gas container.

4. The system according to claim 2, wherein said variable volume gas container comprises:

a freely movable piston that is responsive to a pressure differential between said external ambient pressure and said internal pressure within said variable volume gas container for adjusting the volume of said variable volume gas container.

5. The system according to claim 1, wherein said variable volume gas container comprises:

a flexible diaphragm that is responsive to a pressure differential between said external ambient pressure and said internal pressure within said variable volume gas container for adjusting the volume of said variable volume gas container.

6. The system according to claim 1, wherein said variable volume gas container comprises:

a freely movable piston that is responsive to a pressure differential between said external ambient pressure and said internal pressure within said variable volume gas container for adjusting the volume of said variable volume gas container.

7. The system according to claim 1, wherein said motor housing comprises said variable volume gas container.

8. The system according to claim 7, wherein said variable volume gas container comprises:

a flexible diaphragm that is responsive to a pressure differential between said external ambient pressure and said internal pressure within said variable volume gas container for adjusting the volume of said variable volume gas container.

9. The system according to claim 7, wherein said variable volume gas container comprises:

a freely movable piston that is responsive to a pressure differential between said external ambient pressure and said internal pressure within said variable volume gas container for adjusting the volume of said variable volume gas container.

10. A remotely operated underwater vehicle having a shaft seal pressure compensation system for equalizing pressure across a shaft seal of each motor driven thruster, the vehicle comprising:

at least one motor driven thruster for providing a combination of propulsion and direction control to the vehicle;

said at least one motor drive thruster comprising:

a motor housing defining an enclosed internal space;

a motor within said enclosed internal space and having a shaft extending from said internal space outwardly of said motor housing and terminating at an external location of said motor housing;

a shaft seal between said motor housing and said shaft for making sealing contact between said shaft and said motor housing;

a variable volume gas container responsive to a pressure differential between an external ambient pressure and an internal pressure within said variable volume gas container for adjusting the volume of said variable volume gas container so that said internal pressure equals said ambient pressure;

said variable volume gas container being pneumatically connected to said motor housing to allow air to freely exchange between said variable volume gas container and said motor housing for pressurizing said enclosed internal space of said motor housing so that it equals said ambient pressure, thereby equalizing the pressure across said shaft seal.

11. The vehicle of claim 10, wherein said variable volume gas container is located at the center of buoyancy of the vehicle.

12. The vehicle of claim 11, wherein said variable volume gas container comprises:

a flexible diaphragm that is responsive to a pressure differential between said external ambient pressure and said internal pressure within said variable volume gas container for adjusting the volume of said variable volume gas container.

13. The vehicle of claim 11, wherein said variable volume gas container comprises:

a freely movable piston that is responsive to a pressure differential between said external ambient pressure and said internal pressure within said variable volume gas container for adjusting the volume of said variable volume gas container.

14. The vehicle of claim 10, wherein said variable volume gas container comprises:

a flexible diaphragm that is responsive to a pressure differential between said external ambient pressure and said internal pressure within said variable volume gas container for adjusting the volume of said variable volume gas container.

15. The vehicle of claim 10, wherein said variable volume gas container comprises:

a freely movable piston that is responsive to a pressure differential between said external ambient pressure and said internal pressure within said variable volume gas container for adjusting the volume of said variable volume gas container.

16. The vehicle of claim 10, wherein said motor housing comprises said variable volume gas container.

17. The vehicle of claim 16, wherein said variable volume gas container comprises:

a flexible diaphragm that is responsive to a pressure differential between said external ambient pressure and said internal pressure within said variable volume gas container for adjusting the volume of said variable volume gas container.

18. The vehicle of claim 16, wherein said variable volume gas container comprises:

a freely movable piston that is responsive to a pressure differential between said external ambient pressure and said internal pressure within said variable volume gas container for adjusting the volume of said variable volume gas container.

* * * * *